US005884425A

United States Patent [19]

Baldwin

[11] Patent Number: 5,884,425

[45] Date of Patent: Mar. 23, 1999

[54] ANTI-TAMPER TAG WITH THEFT PROTECTION

[75] Inventor: John Baldwin, Philadelphia, Pa.

[73] Assignee: Avery Dennison Corporation, Pasadena, Calif.

[21] Appl. No.: 37,754

[22] Filed: Mar. 10, 1998

Related U.S. Application Data

[63] Continuation-in-part of Ser. No. 862,618, May 23, 1997.

[51] Int. Cl.[6] ..... G09F 3/10

[52] U.S. Cl. ..... 40/638; 40/630; 340/572; 283/101; 283/102; 428/42.3

[58] Field of Search ..... 340/572; 40/630, 40/638; 283/101, 108; 428/42.3

[56] References Cited

U.S. PATENT DOCUMENTS

| | | | |
|---|---|---|---|
| 3,900,219 | 8/1975 | D'Amato et al. | 283/101 |
| 3,983,645 | 10/1976 | Rycroft | 40/630 |
| 4,260,656 | 4/1981 | Mullen | 428/42.3 |
| 4,309,468 | 1/1982 | St. Aubin | 428/42.3 |
| 4,547,001 | 10/1985 | Stitt | 283/81 |
| 4,577,426 | 3/1986 | Jenkins | 40/638 |
| 4,787,158 | 11/1988 | Vitol | 40/638 |
| 5,008,649 | 4/1991 | Klein | 340/572 |
| 5,346,259 | 9/1994 | Mocilnikar et al. | 283/108 |
| 5,379,538 | 1/1995 | Osborne | 40/638 |
| 5,411,295 | 5/1995 | Bates et al. | 283/81 |
| 5,484,167 | 1/1996 | Donaldson et al. | 283/67 |
| 5,618,112 | 4/1997 | Lovell | 283/103 |

*Primary Examiner*—Jeffery A. Hofsass
*Assistant Examiner*—Benjamin C. Lee
*Attorney, Agent, or Firm*—Spencer & Frank

[57] ABSTRACT

An anti-tamper tag arrangement includes a release liner and a thin film strip having first and second sides and a longitudinal direction. The thin film strip has a tear weakness in the longitudinal direction and a resistance to tear in a direction transverse to the longitudinal direction, the first side of the thin film strip has a first region containing a pair of parallel slits extending in the longitudinal direction of the thin film strip and a transverse slit connecting the pair of parallel slits to form a tear strip and a second region for being printed with variable print information located outside of the first region and being in a longitudinal tear path of the tear strip defined by the pair of parallel slits. A coating of pressure-sensitive adhesive is deposited on the second side of the thin film strip. The thin film strip is removably fixed to the release liner by the adhesive coating. The thin film strip with its coating of pressure-sensitive adhesive is releasable from the release liner without tearing the tear strip and the adhesive coating has sufficient tack to adhere to a surface different from the release liner so that when the thin film strip is removed from the different surface the tear strip remains attached to the different surface and tears along the longitudinal tear path.

21 Claims, 3 Drawing Sheets

ANTI-TAMPER TAG WITH THEFT PROTECTION

CROSS-REFERENCE TO RELATED APPLICATIONS

This application is a continuation-in-part of U.S. patent application Ser. No. 08/862,618, filed May 23, 1997, the disclosure of which is incorporated herein by reference.

BACKGROUND OF THE INVENTION

The invention relates to tags and pressure-sensitive labels imprinted with information, such as sale price and other product information, for application to products offered for sale and, more particularly, to tags and labels having protection features which minimize the possibility of price-switching by removal and reapplication of the tag or label to a different product. Throughout the remainder of this specification, the words "tag" and "label" are used interchangeably and each is intended to comprehend a product marker, however, the marker is attached to a product. Generally, the tag or label will be applied to a product by a pressure-sensitive adhesive or will be passed around a portion of the article, such as a handle or strap, and adhered to itself to form a loop. The invention further relates to theft protection devices attached to products that trigger alarms when brought into the vicinity of product sensors.

Theft is estimated to cost retailers in excess of $10 billion annually. Theft from retail establishments can include price switching, as well as actual shoplifting and employee theft. Price switching is characterized by removing a label from a product with a lower price and affixing that label to a more expensive product. Depending upon the price point variance within a specific line of merchandise, this activity can cause accelerated losses beyond even shoplifting.

Electronic article surveillance systems, known as "EAS" systems, have been developed to protect retailers from theft. EAS systems utilize electronic protection devices attached to products that trigger alarms when brought into contact with product sensors enclosed within gates or pedestals at store entrances. Products which include EAS protection are deactivated at the time of checkout so that properly purchased products can move through the gates without triggering the alarms.

Applying the EAS device to the product is time-consuming and is normally done at the distribution or store level, which causes delays with the product reaching the selling floor and adds layers of cost throughout an organization. Moreover, once an EAS circuit is discovered on a product, it often can be removed or disabled with limited skill, making the product an easy target for theft by shoplifters. Depending upon the size and category of the merchandise, it can be vulnerable to price-switching, shoplifting and/or employee theft.

SUMMARY OF THE INVENTION

It is an object of the invention to provide an anti-tamper tag for application to products offered for sale which can minimize, if not prevent, price-switching.

It is a further object of the invention to provide a tag with anti-tamper features which can be combined in a cost-saving manner with electronic article-surveillance systems, toward a goal of minimizing theft by way of price-switching, shoplifting, and employee theft.

The above and other objects are accomplished according to the invention by the provision of an anti-tamper tag arrangement, including: a release liner; a thin film strip having first and second sides and a longitudinal direction, the thin film strip having a tear weakness in the longitudinal direction and a resistance to tear in a direction transverse to the longitudinal direction, the first side of the thin film strip having a first region containing a pair of parallel slits extending in the longitudinal direction of the thin film strip and a transverse slit connecting the pair of parallel slits to form a tear strip, and a second region for being printed with variable print information located outside of the first region and being in a longitudinal tear path of the tear strip defined by the pair of parallel slits; and a coating of pressure-sensitive adhesive deposited on the second side of the thin film strip, the thin film strip being removably fixed to the release liner by the adhesive coating, wherein the thin film strip with its coating of pressure-sensitive adhesive is releasable from the release liner without tearing the tear strip and the adhesive coating has sufficient peel strength to adhere to a surface different from the release liner so that when the thin film strip is removed from the different surface the tear strip remains attached to the different surface and tears along the longitudinal tear path.

In a preferred embodiment of the invention, the transverse slit is curved, for example semi-circular, which ensures that the tear strip will-have a predictable tear pattern in the longitudinal direction of the thin film strip. It has been found that other shapes for the transverse slit, such as triangular or straight, will work, but may not produce optimum results because, unlike the curved, and more particularly, semicircular transverse slit, other shapes do not ensure tear will be initiated and continue in a predictable longitudinal direction.

According to a further aspect of the invention, the transverse slit which connects one end of the parallel slits is remote from the second region containing the variable print information, so that when the thin film strip is peeled away from the different surface, the tear strip will tear in the longitudinal direction toward and through the second region containing the variable print information to provide evidence of tampering.

According to a preferred embodiment of the invention, there are a plurality of like configured tear strips positioned in the first region, extending in the longitudinal direction of the thin film strip. Preferably, there are at least a plurality of like configured tear strips laterally spaced from one another across the thin film strip in the direction transverse to the longitudinal direction, so as to increase the likelihood that one of the tear strips will tear through variable print information in the second region of the thin film strip.

More preferably, the region of the thin film strip containing the variable print information is disposed between two sets of tear strips which are oriented so that each set of tear strips will tear through the variable print information in dependence on which edge of the thin film strip is initially removed from the different surface.

According to yet a further embodiment of the invention, the thin film strip is elongated and has first and second portions spaced apart from one another in the longitudinal direction of the thin film strip, and the first and second regions of the first side of the thin film strip are located within the first portion. The second side of the second portion constitutes the different surface when the release liner is removed, so that the first and second portions can be adhered to one another. The anti-tamper tag according to this embodiment of the invention can be thus passed around an object and adhere to itself to thereby form a loop around the object, for example, the handle of a piece of luggage.

According to a further feature of this embodiment of the invention, the release liner has first and second scores transverse to the longitudinal direction of the thin film strip and spaced apart from one another to define a central portion of the release liner and first and second portions of the release liner on opposite sides of the central portion. The first and second portions of the release liner can be removed from the thin film strip and separated from the central portion of the release liner. The central portion of the release liner remains adhered to the thin film strip, so that the corresponding portion of the thin film strip does not adhere to the object or to itself. The first and second portions of the thin film strip can then be adhered to one another to form the loop without the corresponding central portion of the thin film strip being adhered to itself or the object.

According to another feature of this embodiment of the invention, the release liner has two central side portions cut away from the tag, leaving first and second end portions and a narrow central portion. The release liner is removed from the first and second end portions and the narrow central portion. The first and second end portions of the tag can then be adhered to one another to form a loop, and the narrow central portion can be adhered to the article.

According to a further aspect of this embodiment of the invention, the second region of the thin film strip, which is imprinted with variable print information, is disposed between the first end region containing the tear strip and a free end of the first portion of the thin film strip. Preferably, the free end of the first portion of the thin film strip contains a plurality of parallel slits in the longitudinal direction of the thin film strip, so that if it is attempted to separate the first and second portions of the thin film strip after being adhered to one another, the first portion of the thin film strip will tear in the longitudinal direction along at least one of the parallel slits at the free end thereof or in the first region.

According to a further aspect of the anti-tamper tag of the invention, a thin electronic protection circuit (referred to above as an EAS device) is disposed between the release liner and the second side of the thin film strip, and adheres to the thin film strip by the pressure-sensitive adhesive. In one embodiment, the thin electronic protection circuit is located within an area of one of the portions of the thin film strip and becomes sandwiched between the first and second portions of the thin film strip when they are adhered to one another. Additionally, it is preferable that the thin electronic protection circuit has an area that is less than the area of the one portion of the thin film strip, and is centrally arranged within that one portion so that a band of the pressure-sensitive adhesive surrounds the thin electronic circuit for adhering to the release liner and to the second portion of the thin film strip once the loop is formed and the two portions adhered.

Other features and advantages of the invention will become apparent from the following detailed description considered in conjunction with the accompanying drawings.

BRIEF DESCRIPTION OF THE DRAWINGS

In the drawings, similar reference numerals refer to similar items.

DETAILED DESCRIPTION OF THE INVENTION

Figure 1:
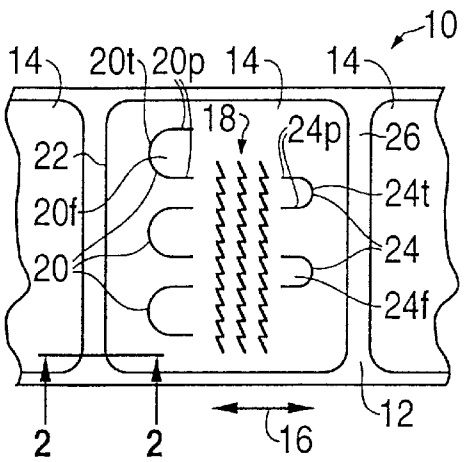
FIG. 1 is a plan view of the front side of a portion of a web of anti-tamper tags according to a first embodiment of the invention.

Referring to FIG. 1, there is shown a web 10 comprising a silicone coated paper 12 to which there is adhered a series of anti-tamper tags 14 constructed in accordance with one embodiment of the invention. Tags 14 are shown as generally rectangular although other shapes are possible. Tags 14 are made of a monoaxially oriented polyolefin film 5 which, in FIG. 1, is oriented in a longitudinal direction of web 10 as indicated by arrow 16. The monoaxially oriented polyolefin film 5 comprising tag 14 is resistant to tear in a direction transverse to longitudinal direction 16 and is relatively easily torn along longitudinal direction 16, particularly if the tear is initiated along a longitudinal slit or cut.

In this configuration, and in accordance with the invention, each tag 14 is provided with a plurality of U-shaped die cuts arranged in the longitudinal direction on each side of a central region 18. The central region 18 is intended to receive variable print information containing, for example, a bar code, price, and/or other information concerning an article to which the tag is ultimately applied. As shown in FIG. 1, a first set of U-shaped die cuts 20 is disposed between one edge 22 of tag 14 and central region 18 and a second set of die cuts 24 is arranged between central region 18 and opposite edge 26 of tag 14. Each of the U-shaped die cuts 20 comprises a curved, for example, semi-circular die cut 20*t* that generally extends transverse to the longitudinal direction 16 and is connected to one end of a pair of parallel legs 20*p* that extend in longitudinal direction 16 to form a tear strip or flap 20*f*. Further, the plurality of U-shaped die cuts 20 are spaced apart across tag 14 in a direction transverse to the longitudinal direction 16. Similarly, U-shaped die cuts 24 have semi-circular transverse die cuts 24*t* connecting parallel legs 24*p* which extend in the longitudinal direction of tag 14 to form tear strips or flaps 24*f*. The plurality of die cuts 24 are spaced apart in a direction transverse to the longitudinal direction 16. Although not necessary, as shown in FIG. 1, the parallel legs of each U-shaped die cut 24 are aligned with the legs of adjacent U-shaped die cuts 20.

Figure 2:
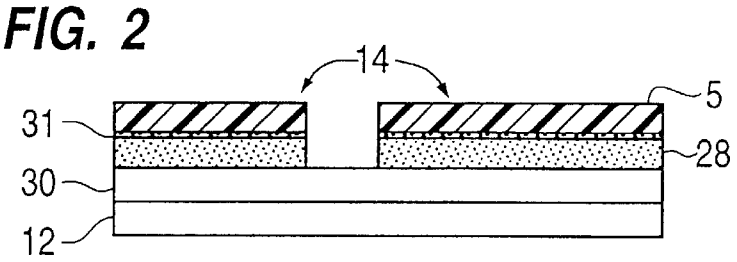
FIG. 2 is a cross-sectional view of a portion of the web shown in FIG. 1 along line 2—2.

Referring to FIG. 2, there is shown a cross-sectional view of a portion of web 10 along line 2—2 in FIG. 1. As shown in FIG. 2, tag 14, constituted by the monoaxially polyolefin film 5, has on its underside a layer of pressure-sensitive adhesive 28 by which the polyolefin film 5 adheres to the release liner 12 via a silicone coating 30. Preferably, the release value between adhesive 28 and silicone coating 30 is in a range of about 60 to about 150 gms to insure that when tag 14 is peeled from release liner 12, flaps 20*f* and 24*f* will separate from the liner intact with the remainder of the tag, thus avoiding initiation of a tear in longitudinal direction 16 along any one of the legs 20*p* and 24*p*. The peel strength of the adhesive for adhering the polyolefin tag 14 to an article made of, for example, glass, plastic, or steel, should preferably be in a range of about 2 to about 7 lbs./inch, so that if an attempt is made to remove tag 14 from the article, a flap 20*f* or 24*f* of at least one of the U-shaped die cuts 20 or 24, respectively, will remain attached to the article by the adhesive so as to initiate a tear along one of the pairs of parallel legs 20*p* or 24*p*.

The adhesive 28 may comprise a commercially available pressure-sensitive adhesive, for example, a pressure-sensitive adhesive based upon an emulsion acrylic technology. A suitable adhesive for this purpose is included as part of a pressure-sensitive adhesive paper label stock, sold by Avery Dennison Corporation under the FASCOVER trademark. The adhesive may also comprise an approximately 20–30 gm/ream layer of hot melt pressure-sensitive adhesive, such as the S-246 hot melt sold by Avery Dennison, or the H2187-01 hot melt, pressure-sensitive adhesive sold by Ato Findley, Inc., Wauwatusa, Wis., or the adhesive compositions taught in U.S. Pat. No. 3,239,478 to Harlan, Jr. Instead of a hot melt, the adhesive layers may comprise a cross-linked acrylic adhesive.

Tag 14 of FIG. 2 preferably includes an opaque barrier 31 which is indicated in FIG. 2 by the heavy line. The opaque barrier is preferably an opaque coating or a masking film, and is a grey color, water-based emulsion blockout with high opacity and hiding power. In a preferred embodiment, the opaque barrier comprises a system including UV curable tri-functional and di-functional acrylated monomers and oligomers with a small portion of vinyl ethers and acrylated-urethane oligomers. Such a system is a 100% solids blend containing a UV photo initiator. The system is coated using a seven roll coater (five rolls functional) in a forward mode. Approximately 3 gsm are applied. The system may include a trace amount of carbon black to increase hiding. Titanium dioxide may additionally be used for white hiding. Curing is provided by passing the web under two banks of Fusion 600 watt "H" bulbs for a total of 1200 watts at 400 fpm under a nitrogen atmosphere. The dose is somewhere around 250 mj/cm$^2$. The nitrogen atmosphere provides about 100 ppm oxygen or less to reduce quenching of radicals by atmospheric oxygen. An opaque barrier of this type is additionally described in U.S. patent application Ser. No. 08/584,256, assigned to Avery Dennison, the disclosure of which is incorporated herein by reference.

The orientation of parallel legs or slits 20*p* and 24*p* in longitudinal direction 16 insures that the tear will occur in a predictable longitudinal path through the variable print information in region 18 when a sufficient portion of tag 14 is removed from the article to thus provide evidence of tampering. In fact, if the variable print information in region 18 contains a bar code, a tear through the bar code will normally prevent the bar code from being read by a bar code reader, no matter how neatly the tag is reapplied to an article in a price switching operation.

A system comprising a monoaxially oriented polyolefin film secured via a permanent adhesive to a release liner which may be used for web 10 is commercially available from Avery Dennison Corporation under product identification numbers 73031 and 74087 in the form of a wound, roll product. These products are covered by one or more of the following U.S. Pat. Nos. 4,713,273; 4,888,075; 4,946,532; 5,143,570; 5,372,669; 5,186,782; and 5,516,393, all assigned to Avery Dennison Corporation, and the disclosures of which are incorporated herein by reference. These patents describe the composition of the components of the web and methods of making the same. In general, the monoaxially oriented polyolefin film used for the tag 14 may be a monoaxially oriented polypropylene film. The adhesive 28 is a permanent adhesive comprising an emulsion acrylic adhesive or a rubber based permanent adhesive. Finally, the liner 12 may comprise a 50-pound semi-bleached, supercalendared, craft stock paper.

Web 10 shown in FIG. 1 is created by passing the web of a roll product as described above through a conventional rotary die cutting machine which die cuts the perimeter of the individual tags 14 in place on web 12 and forms the U-shaped die cuts 20 and 24 as shown in FIG. 1. Preferably, tags 14 will be cut around their perimeter so as to provide a space between the individual tags and a space between the tags and the lateral edges of release liner 12 so as to insure that the peripheral edge around each individual tag 14 has no nicks. The gap between adjacent tags as shown in FIG. 1 is important only in that it aids in removing the tag from the liner. The fact that the tag has no nicks on its edges is important as such a nick could cause unintentional tearing when the tag is removed from the liner. The space between tag edges 22, 26 and the "U" shaped die cuts is also important as this space maintains the outer edge integrity without nicks or scores and allows the label to be removed from the liner without initiating longitudinal tearing. That is, if a nick were present on one of the edges 22, 26, this could unintentionally initiate a tear when tag 14 is removed from release liner 12. A web 10 prepared as described above may be custom printed in central region 18 with product and price information, for example, by conventional thermal transfer technology. Subsequent to printing, web 10 may be rewound in a roll for later use whereby the individual tag 14 may be peeled away from release liner 12 and applied to a product as discussed above to provide an anti-tamper tag which, due to the tear strips as discussed above, will minimize price switching by creating tamper evidence when an attempt is made to remove the tag from a product.

Figure 3:
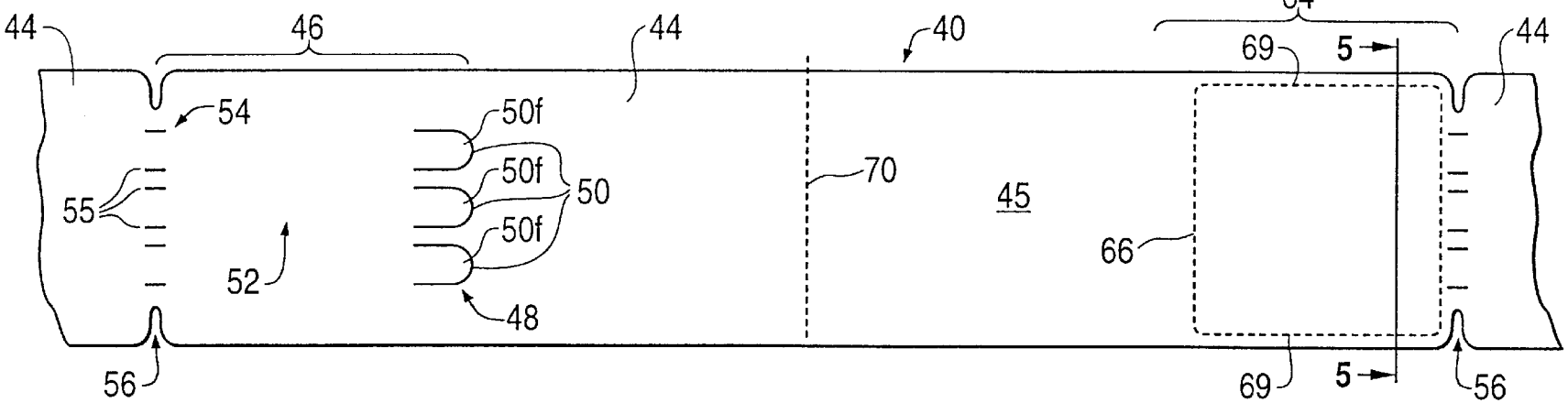
FIG. 3 is a plan view of the front side of a portion of a web containing an anti-tamper tag with an electronic protection circuit according to a further embodiment of the invention.
Figure 4:
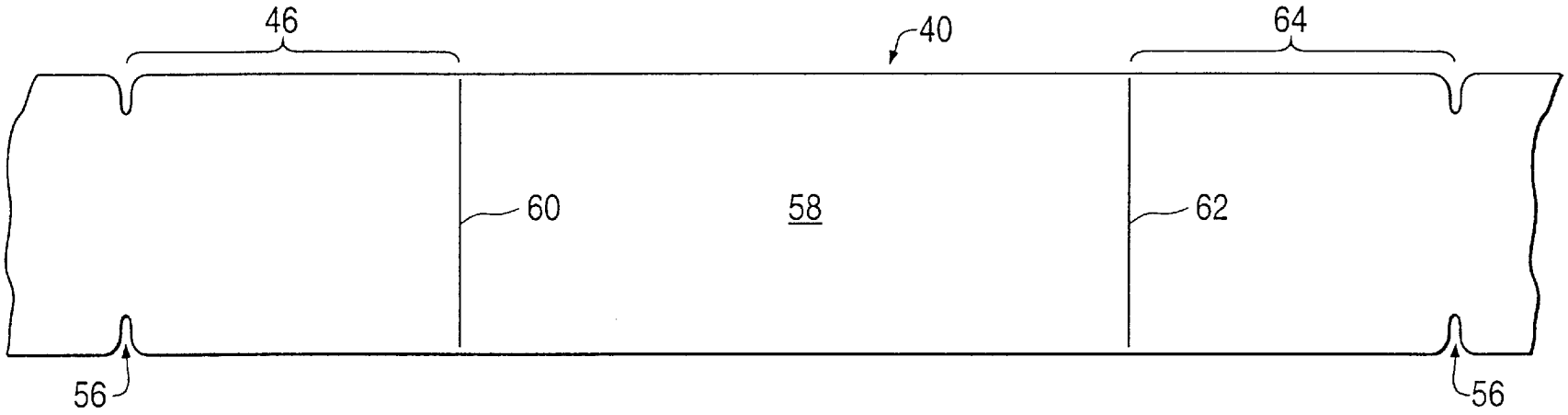
FIG. 4 is a plan view of the reverse side of the web shown in FIG. 3.
Figure 5:
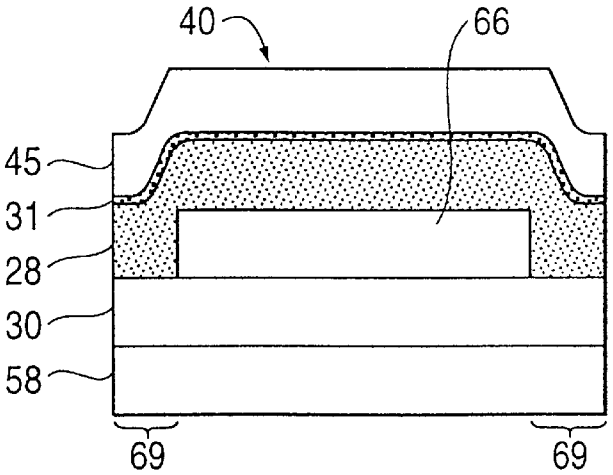
FIG. 5 is a cross-sectional view of the web shown in FIG. 3 along line 5—5.

FIGS. 3–5 illustrate a loop tag in accordance with another embodiment of the invention which combines the anti-tamper features discussed above with an electronic article surveillance device (EAS) that is utilized to combat shop-lifting. Loop tags are suitable for price and other product information marking of a variety of merchandise which has a handle, a narrow bridge, or the like, such as luggage, book packs, purses, belt loops, sunglasses, etc., around which the loop tag of the invention can be passed.

FIG. 3 is a plan view of a front or marking side of a web 40 comprised of an outer layer 45. FIG. 4 is a plan view of the reverse side of FIG. 3 comprised of a silicone coated paper liner 58 adhered to the outer layer 45. The outer layer 45 preferably comprises the monoaxially polyolefin thin film 5 as discussed in connection with FIGS. 1 and 2.

As shown in FIG. 3, outer layer 45 is die cut to present individual loop tags 44. Each loop tag 44 has a first end portion 46 which contains a first region 48 containing a plurality of U-shaped die cuts 50 forming flaps 50*f*. End portion 46 contains a second region 52 which is intended to receive custom printed information containing price and other product information. Preferably, end portion 46 contains a third region 54 which has a plurality of parallel slits 55 which when loop tags 44 are severed from one another at recesses 56 by a cutting machine, extend from the free end of end portion 46.

FIG. 4 illustrates the reverse side of the web 40 of FIG. 3. Release liner 58 has first and second scores 60 and 62 spaced from one another in the longitudinal direction of web 40 between recesses 56. Score 60 in release liner 58 is arranged to define the longitudinal extent of end portion 46. Score 62 is located to define a second end portion 64 of loop tag 44.

Referring again to FIG. 3 there is shown in dotted outline a device 66, such as an electronic article surveillance (EAS) device, and which is disposed between outer layer 45 and release liner 58. An EAS device is a thin RF (radio frequency) printed circuit device which may contain, for example, a resonant circuit that is intended to set off an alarm when in proximity of a compatible detector as is well known in the art. EAS devices are commercially available.

As shown in FIG. 5, the device 66 is adhered to the outer layer 45 by a pressure-sensitive adhesive 28, which is coated on the non-marking side of the outer layer 45. Similar to the release liner 12 in FIG. 2, the release liner 58 has a silicone coating 30. Preferably, the device 66 is dimensioned to leave a gap 69 between the respective edge of the EAS device and the corresponding edge of outer layer 45 so that release liner 58 adheres to outer layer 45 in the region of gaps 69.

Preferably, outer layer 45 is die cut with a perforation 70 centrally located between the ends of loop tag 44 defined by recesses 56 to define a fold line.

A continuous web of loop tags 44 as depicted in FIGS. 3 and 4 is made starting with a roll of stock material comprised of a lamination of silicone release liner adhered to a monoaxially oriented polyolefin film outer layer by a pressure-sensitive adhesive, as previously discussed. The lamination is delaminated (separated), for example, with the use of a Label Air Applicator made by Label Air Inc. for insertion of device 66. The material is then re-laminated (i.e., joined together) with the device 66 inside. The U-shaped die cuts, perforations and rounded corners are then added to the stock material with the use of a conventional rotary die cutting machine to create the finished roll product which is wound onto smaller cores containing, for example, 500 loop tags each. Conventional thermal transfer technology may be used to custom imprint product and price information on the marking side of the web.

A wound roll produced in accordance with the above is then placed through a high speed cutter and stacker and cut into singles, i.e., individual loop tags 44, by cuts made at the locations identified by recesses 56.

Preferably, the various machines utilized in the production process, including the Label Air Applicator, winding units, printer, cutter and stacker machines are provided with anti-static kits since the devices 66, if electronic, are sensitive to static and could be rendered inactive with excessive static levels. Further, it is preferable that the production process be conducted in a high humidity environment. Optimal circuit performance of the electronic devices 66 requires that humidity levels exceed 35 to 40%.

In use, individual loop tags 44 are applied to an article, such as the handle of a piece of luggage, by removing the release liner 58 attached to end portions 46 and 64, threading the loop tag through the handle, and pressing the end portions of the loop tag together so that the adhesive on end portion 46 adheres to the exposed device 66 and the surrounding portions of the outer layer 45. The release liner 58 still attached to the central portion of the loop tag between die cuts 60 and 62 remains intact so that the central portion of the loop tag does not stick to the article or itself. In an alternative production process, instead of permanently covering the central (loop) portion of the adhesive with a liner, the adhesive may be selectively printed in the end portions 46 and 64 on the non-marking side of the outer layer 45.

In use, the anti-tamper U-shaped die cuts 50 and parallel slits 54 operate in a manner similar to that discussed above in connection with the embodiment of FIGS. 1 and 2. That is, if a person tries to separate the adhered end portions 46 and 64 from one another by pulling on the central (loop) portion of the tag, flaps 50*f* at the interior of U-shaped die cuts 50, serve as anchor points wherein on continuing separation of the end portions, linear tears begin at the parallel slits of the U-shaped die cuts and extend through region 52 containing the imprinted information concerning the product so that tampering becomes evident. Likewise, if a person attempts to separate adhered outer portions 46 and 64 of looped tag 44 at the free end of the loop tag containing the parallel slits 54, a predictable tear will result in the longitudinal direction through the region 52 to again provide evidence of tampering.

The presence of an EAS device 66 is utilized in the customary manner to prevent shoplifting by setting off an alarm when the product with the attached loop tag is placed in proximity of an appropriate detector. Incorporation of the EAS device in the loop tag minimizes time and costs involved in connection with the prior art use of such EAS devices which had to be separately applied to products independent of the tag. Furthermore, the non-integrated EAS devices as known in the prior art must not only be applied separately but they can be openly seen and often cover up valuable packaging information in addition to being vulnerable to removal or damage. Embedding the EAS device in accordance with the invention overcomes these problems.

The use of loop tags with EAS devices prevents price switching as well as theft. Of course, loop tags may be used without EAS devices, in which case the loop tag will prevent price switching only. The position of EAS devices, U-shaped die cuts, slits and imprint information may change from what is shown in FIGS. 3–4 without departure from the invention.

As in the embodiment of FIGS. 1 and 2, the use of a monoaxially oriented polyolefin films for the outer layer 45 is significant. The film is oriented along the same (longitudinal) axis as the parallel legs of the U-shaped die cuts 50 and parallel slots 54. This orientation causes a tear to propagate longitudinally rather than laterally, which is a preferred failure mode for tamper evident purposes.

Additionally, the location of the EAS device at the end portion of the tag in conjunction with the loop design of the tag, offers the advantage of isolating the device from metallic and other products which can interfere with operation of the RF circuitry. Further, the opaque barrier 31 hides the device 66 from visible perception and can be selectively applied to the loop tag, such as to the entire loop tag, end portion 46, end portion 64, or both end portions 46 and 64.

Figure 6:
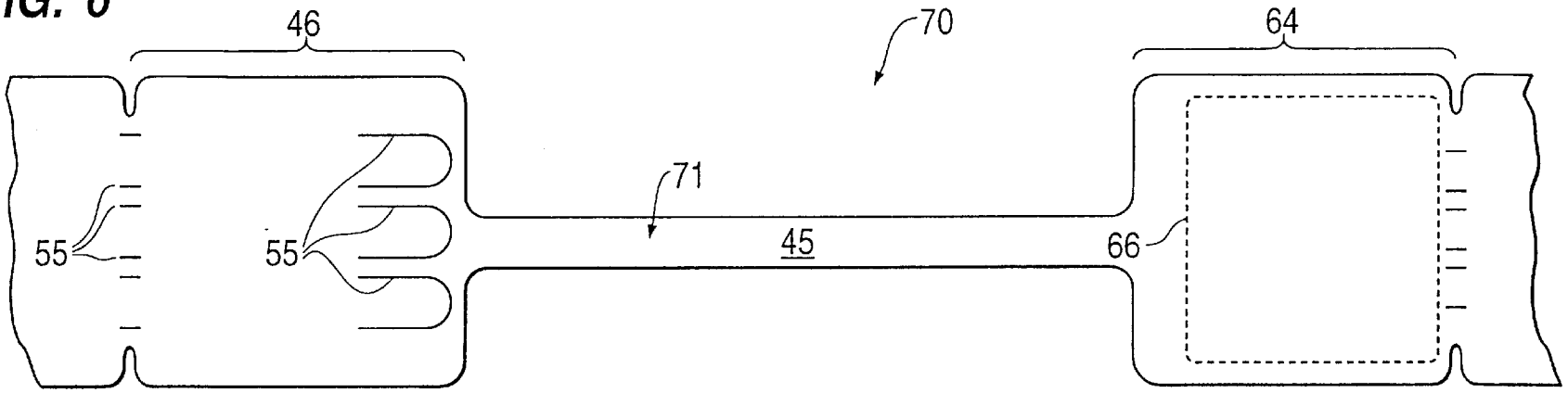
FIG. 6 is a plan view of an alternative front side of the web shown in FIG. 3.
Figure 7:
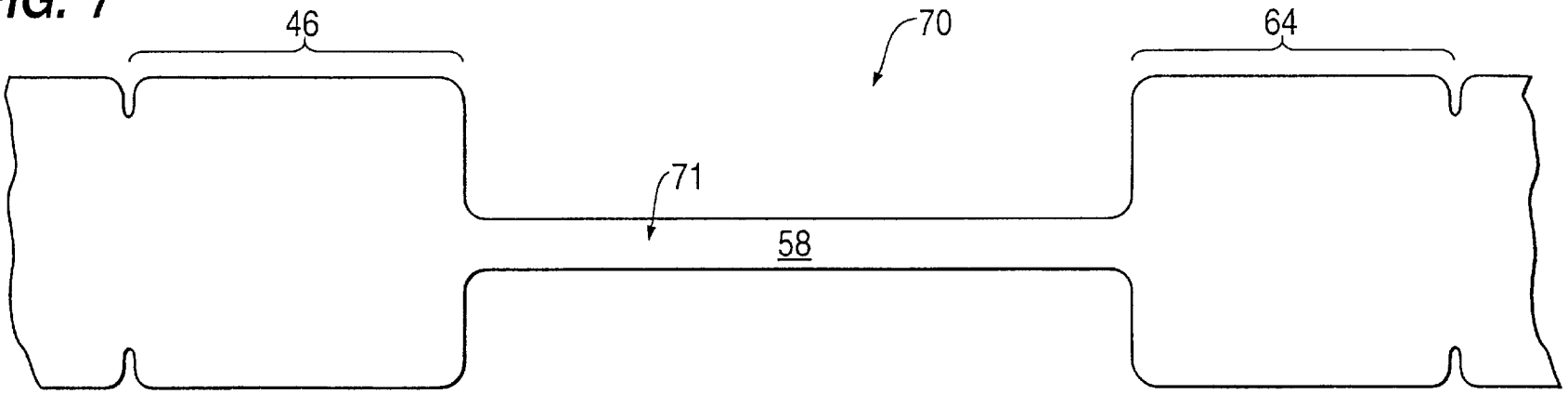
FIG. 7 is a plan view of the reverse side of the web shown in FIG. 6.

In an alternative embodiment to FIGS. 3 and 4, the loop tag of FIGS. 6 and 7 is adhered to substantially cylindrical articles, such as lipstick cases, eye shadow cases, cosmetic cases, the nose bridge or earpiece of eyeglasses, and power cords. As illustrated in the plan view of FIG. 6, which is an alternative to the plan view illustrated in FIG. 3, central side portions of the loop tag 70 are cut away from the tag, leaving end portions 46 and 64 and a narrow central portion 71. FIG. 7 is a plan view of the reverse side of the plan view illustrated in FIG. 6. In practice, the loop tag 70 is applied to the article by removing release liner 58 from end portion 46, central portion 71, and end portion 64. The loop tag is then wrapped around the article so that end portions 46 and 64 are adhered to one another, and narrow central portion 71 is adhered to the article.

For the alternative embodiment of FIGS. 6 and 7, the adhesive to which release liner 58 is attached has the property that where the loop tag is adhered to itself, it grips with a very high peel strength. Further, where the loop tag is attached to the article, it can be removed from the article, which is typically made of a material such as PVC, metal, or glass, without leaving a significant residue. Such an adhesive is commercially available from Avery Dennison Corporation under product identification number 8335.

As an alternative to the loop tag of FIGS. 6 and 7, scores can be included in the release liner 58, like the scores 60 and 62 in FIG. 4, to define the end portions 46 and 64 and the narrow central portion 71. In practice, the release liner 58 is removed from end portions 46 and 64, but retained in the narrow central portion 71. The loop tag is then wrapped around the article so that end portions 46 and 64 are adhered to one another, and narrow central portion 71 is not adhered to the article.

Besides using an EAS device as the device 66 in FIGS. 3–7, other types of electronic protection devices, including, but not limited to, devices that emit a RF identification signal, can be used. Further, any type of thin, flat, and flexible device can be used, where the device is not limited to an electronic device.

One example of an electronic protective device is a swept RF EAS device, which is an active device that responds by modulating an incoming RF signal. The swept RF EAS device comprises a planar conductive material cut into a pair of inverse first and second spiral conductors wrapped about each other and positioned for capacitive and inductive coupling. The two spiral conductors are positioned relative to one another to produce a resonant circuit. The conductors of each circuit are connected by welding to produce a resonant circuit.

The swept RF EAS device preferably includes a deactivator. The deactivator includes a composite strip with a conductive layer, a normally nonconductive layer adhered to the conductive layer, and a coating surrounding the adhered layers. The deactivator is positioned in proximity to the resonant circuit so that, when excess energy is applied to the deactivator, the normally non-conductive layer becomes conductive and the coating is rendered ineffective, whereby the resonant circuit is deactivated.

The swept RF EAS devices typically have a square or rectangular shape with an area of 1.5 square inches to 5 square inches and a thickness varying between 3.5 mils and 9 mils, depending on whether a support material is laminated to the circuit. With a swept RF EAS device, the tag thickness is increased by 2 to 5 mils, depending on the liner and adhesive coating weight used. A commercially available swept RF EAS device is sold under the trademark CHECKPOINT by Checkpoint Systems, Inc., Thorofare, N.J.

An additional example of an electronic protection device is a radio frequency identification (RFID) device, which includes a foil antenna coil and a chip. A typical RFID device is approximately 50 mm by 50 mm square, or approximately 50 mm by 85 mm rectangular. The foil antenna coil has a thickness of approximately 80 $\mu$m, and the chip position has a thickness of approximately 375 $\mu$m. Commercially available RFID devices are sold under the trademark TIRIS by Texas Instruments, Dallas, Tex., and under the trademark SINGLE CHIP RFID by Single Chip Systems, San Diego, Calif.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed:

1. An anti-tamper tag arrangement, comprising:

a release liner;

a thin film strip having first and second sides and a longitudinal direction, the thin film strip having a tear weakness in the longitudinal direction and a resistance to tear in a direction transverse to the longitudinal direction, the first side of the thin film strip having a first region containing a pair of parallel slits extending in the longitudinal direction of the thin film strip and a transverse slit connecting the pair of parallel slits to form a tear strip, and a second region for being printed with variable print information located outside of the first region and being in a longitudinal tear path of the tear strip defined by the pair of parallel slits; and a coating of pressure-sensitive adhesive deposited on the second side of the thin film strip, the thin film strip being removably fixed to the release liner by the adhesive coating, wherein the thin film strip with its coating of pressure-sensitive adhesive is releasable from the release liner without tearing the tear strip and the adhesive coating has sufficient peel strength to adhere to a surface different from the release liner so that when the thin film strip is removed from the different surface the tear strip remains attached to the different surface and tears along the longitudinal tear path.

2. The anti-tamper tag arrangement according to claim 1, wherein the transverse slit is curved.

3. The anti-tamper tag arrangement according to claim 1, wherein the transverse slit is semi-circular.

4. The anti-tamper tag arrangement according to claim 1, wherein the pair of parallel slits has opposite ends and the transverse slit is connected to the opposite end of the pair of parallel slits that is remote from the second region.

5. The anti-tamper tag arrangement according to claim 1, wherein the thin film strip comprises a monoaxially oriented polyolefin material oriented in the longitudinal direction.

6. The anti-tamper tag arrangement according to claim 1, wherein the release liner is elongated and has a longitudinal direction, and the thin film strip includes a plurality of thin film strips releasably fixed to the release liner adjacent one another in the longitudinal direction of the elongated release liner.

7. The anti-tamper tag arrangement according to claim 1, wherein the thin film strip comprises an opaque barrier.

8. The anti-tamper tag arrangement according to claim 1, wherein the tear strip includes a plurality of like-configured tear strips extending in the longitudinal direction.

9. The anti-tamper tag arrangement according to claim 8, wherein the plurality of like-configured tear strips are laterally spaced from one anther across the thin film strip in a direction transverse to the longitudinal direction.

10. The anti-tamper tag arrangement according to claim 8, wherein the plurality of like-configured tear strips comprises a first set of tear strips and the anti-tamper tag includes a third region disposed on a side of the second region remote from the first region and containing a second set of like-configured-tear strips, the first and second sets of tear strips each being oriented to tear in the longitudinal direction toward the second region.

11. The anti-tamper tag arrangement according to claim 1, wherein the thin film strip is elongated and has first and second portions spaced apart from one another in the longitudinal direction of the thin film strip, the first and second regions of the first side of the thin film strip being located within the first portion, the second side of the second portion constituting the different surface so that when the release liner is removed from the first and second portions, the first and second portions can be adhered to one another to form a loop of the thin film strip between the first and second portions.

12. The anti-tamper tag arrangement according to claim 11, wherein the release liner attached to the second side of the thin film strip has first and second scores transverse to the longitudinal direction and spaced apart from one another to define a central portion of the release liner and first and second portions of the release liner on opposite sides of the central portion, the first and second portions of the release liner being separable from the central portion of the release liner to expose the adhesive on the first and second portions of the thin film strip.

13. The anti-tamper tag arrangement according to claim 11, and further including a line of perforations in the thin film strip disposed between opposite longitudinal ends of thin film strip to define a fold line.

14. The anti-tamper tag arrangement according to claim 11, including a plurality of the thin film strips releasably attached to the release liner adjacent to one another in the longitudinal direction.

15. The anti-tamper tag arrangement according to claim 11, wherein the first portion of the thin film strip has a free end and the second region of the thin film strip is disposed between the first end region and the free end of the first portion of the thin film strip.

16. The anti-tamper tag arrangement according to claim 15, further including a plurality of parallel slits extending from the free end of the first portion of the thin film strip in the longitudinal direction.

17. The anti-tamper tag arrangement according to claim 11, wherein the tag has a central portion having a perimeter defined by first and second central side portions and the first and second portions, the first and second central side portions of the tag being cut away from the tag.

18. The anti-tamper tag arrangement according to claim 17, wherein the first, second, and central portions of the release liner are separable to expose the adhesive on the first, second, and central portions of the thin film strip.

19. The anti-tamper tag arrangement according to claim 11, further including a thin electronic protection circuit for activating an alarm when in proximity of a detector and being disposed between the release liner and the second side of the thin film strip and adhering to the thin film strip by the pressure-sensitive adhesive.

20. The anti-tamper tag arrangement according to claim 19, wherein the thin electronic circuit is located within an area of one of the first and second portions of the thin film strip.

21. The anti-tamper tag arrangement according to claim 20, wherein the thin electronic circuit has an area that is less than an area of the one portion of the thin film strip and is centrally disposed within said one portion.

* * * * *